US005923622A

United States Patent [19]

Chung

[11] Patent Number: 5,923,622

[45] Date of Patent: Jul. 13, 1999

[54] WATCH CASE BACK COVER ASSEMBLY

[75] Inventor: Sheng-Kun Chung, Taichung, Taiwan

[73] Assignee: Leader International Watch Co., Ltd., Taichung, Taiwan

[21] Appl. No.: 09/020,260

[22] Filed: Feb. 9, 1998

[51] Int. Cl.[6] ..... G04B 37/00

[52] U.S. Cl. ..... 368/276; 368/309

[58] Field of Search ..... 368/88, 276, 281, 368/285, 309–312

[56] References Cited

U.S. PATENT DOCUMENTS

| | | | |
|---|---|---|---|
| 3,608,304 | 9/1971 | Schaap | 368/309 |
| 3,672,154 | 6/1972 | Hubner | 369/309 |
| 3,846,972 | 11/1974 | Doss | 368/309 |
| 4,228,389 | 10/1980 | Jennard | 368/276 |

*Primary Examiner*—Vit Miska

*Attorney, Agent, or Firm*—Watson Cole Grindle Watson, P.L.L.C.

[57] ABSTRACT

A watch case back cover assembly includes a case back cover removably mounted to a case frame, an elastic member, and a cover plate. The case back cover includes a recess defining an outer side thereof, wherein the recess is defined by a bottom surface and an annular periphery, and wherein the annular periphery has an annular groove defined therein. The elastic member includes at least one elastic piece slidably received in the annular groove and at least one elastic extension bearing against the bottom surface. The cover plate it is secured to the elastic member to rotate therewith and has characters formed on an outer face thereof. The cover plate and the elastic member are rotatable relative to the case back cover when the cover plate is pressed.

4 Claims, 4 Drawing Sheets

WATCH CASE BACK COVER ASSEMBLY

BACKGROUND OF THE INVENTION

1. Field of the Invention

The present invention relates to a watch case back cover assembly, and more particularly to an engagement structure for a watch case back cover which allows the case back cover to be rotated to a position in which the characters on an outer face of the case back cover are in the upright position without adversely affecting the sealing effect.

2. Description of the Related Art

Conventional case back covers might not be exactly in the sealing position if the characters on the outer face thereof are in an upright position. Yet, if the case back covers are positioned on the sealing position, the characters on the outer face thereof might not be exactly in the upright position. The present invention is intended to provide a case back cover assembly which mitigates and/or obviates the above problems.

SUMMARY OF THE INVENTION

A watch case back cover assembly in accordance with the present invention comprises a case back cover removably mounted to a case frame, an elastic member, and a cover plate. The case back cover includes a recess defining an outer side thereof, wherein the recess is defined by a bottom surface and an annular periphery, and wherein the annular periphery has an annular groove defined therein.

The elastic member includes at least one elastic piece slidably received in the annular groove and at least one elastic extension bearing against the bottom surface. The cover plate is secured to the elastic member to rotate therewith and has characters formed on an outer face thereof.

The cover plate is prevented from rotational movement relative to and disengagement from the case back cover as said at least one elastic extension bears against the bottom surface. The cover plate and the elastic member are rotatable relative to the case back cover when the cover plate is pressed.

The bottom surface defining the recess includes an annular rack formed thereon for engaging with said at least one elastic extension. The annular rack may include continuous teeth to allow movement of said at least one elastic extension in either direction. Alternatively, the annular rack may include ratchet teeth to allow movement of said at least one elastic extension in a single direction.

Other objects, advantages, and novel features of the invention will become more apparent from the following detailed description when taken in conjunction with the accompanying drawings.

DESCRIPTION OF THE PREFERRED EMBODIMENTS

Figure 1:
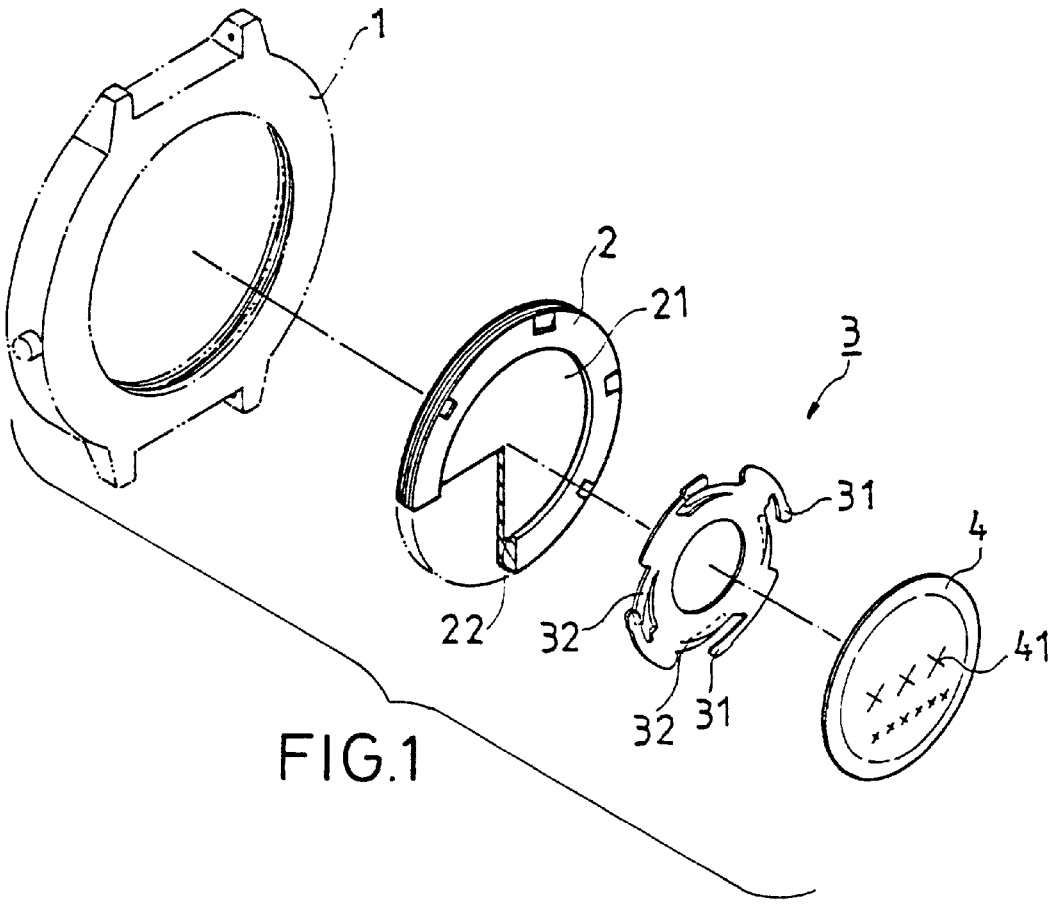
FIG. 1 is an exploded perspective view of a case back cover assembly in accordance with the present invention, in which the case frame is shown by phantom lines.
Figure 2:
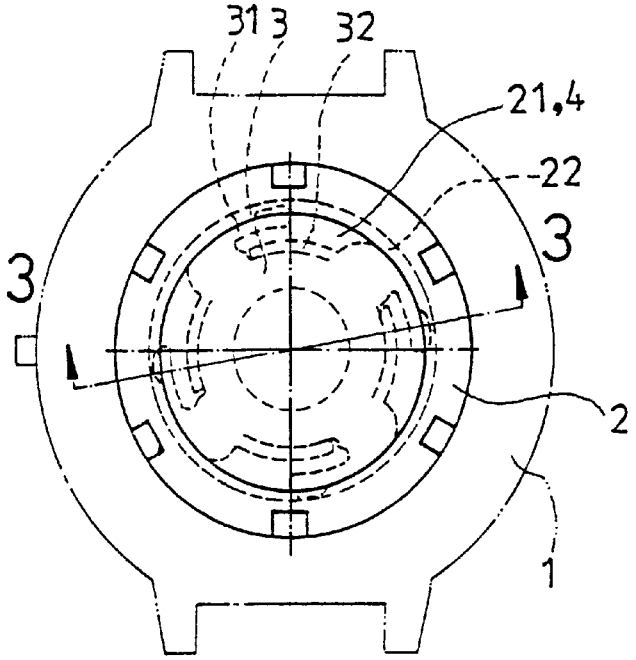
FIG. 2 is a rear side elevational view of the case back cover assembly in accordance with the present invention.
Figure 3:
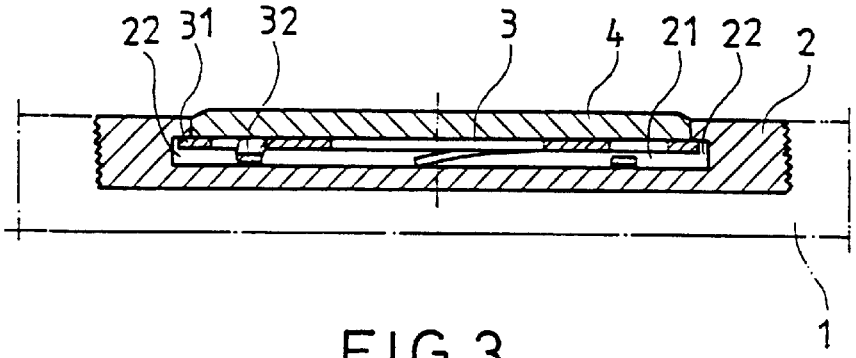
FIG. 3 is a sectional view taken along line 3—3 in FIG. 2.

Referring to the drawings and initially to FIGS. 1 to 3, a watch case back cover assembly in accordance with the present invention generally includes a case back cover 2 adapted to be removably mounted to a case frame 1 by threading engagement which is conventional and therefore not further described. The case back cover 2 includes a recess 21 defined in an outer side thereof, and an annular groove 22 is defined in an annular periphery defining the recess 21. The case back cover assembly further includes an elastic member 3 and a cover plate 4 having characters (e.g., trademark of the watch) on an outer face thereof. The cover plate 4 is securely attached to the elastic member 3 by means of welding, adhesive, or other suitable means, and the combined elastic member 3/cover plate 4 is securely, rotatably mounted in the recess 21.

The elastic member 3 includes a number of elastic pieces 31 slidably received in the annular groove 22 and a number of elastic extensions 32 projecting therefrom for bearing against a bottom surface defining the recess 21. By such an arrangement, the elastic extensions 32 may prevent from disengagement of the cover plate 4 from the case back cover 2 and rotational movement of the cover plate 4 relative to the case back cover 2. After the case back cover 2 is in the sealing position relative to the case frame 1, the user may press the cover plate 4 and rotate the cover plate 4 as well as the elastic member 3 in either direction (clockwise or counterclockwise) until the characters 41 are in the upright position. During rotation of the cover plate 4, the elastic extensions 32 may prevent from disengagement of the cover plate 4 from the case back cover 2.

Figure 4:
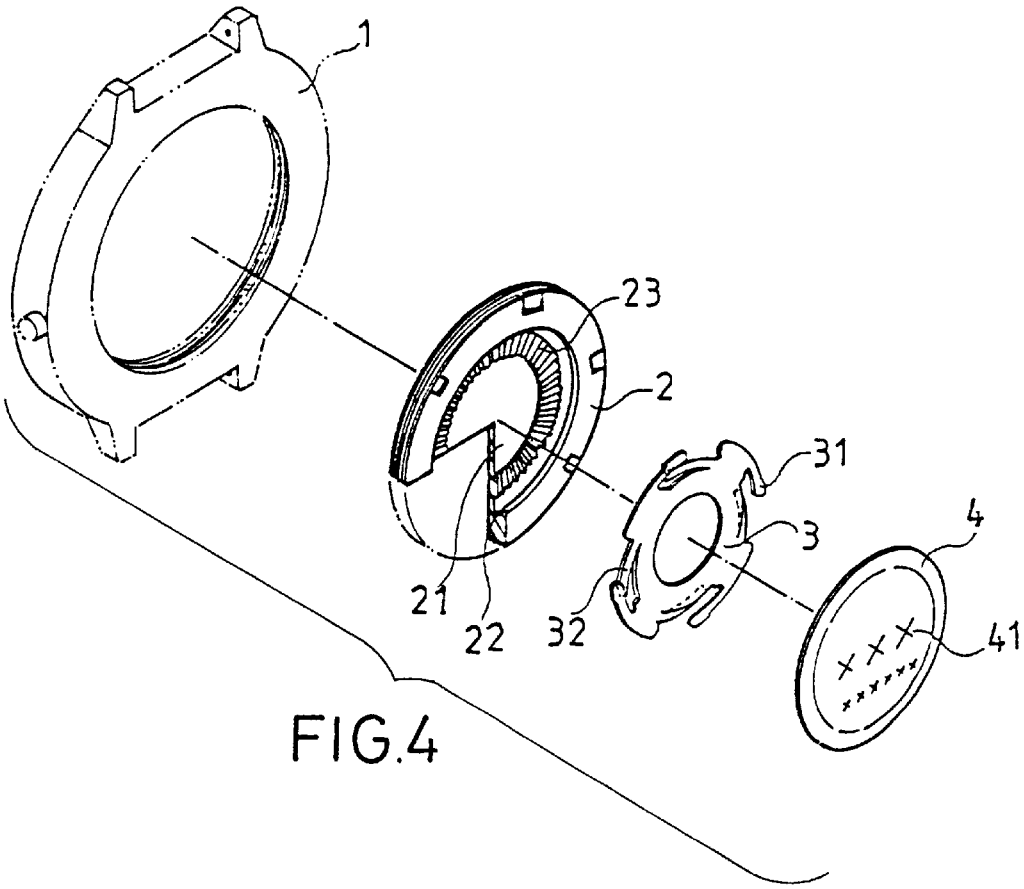
FIG. 4 is an exploded perspective view illustrating a modified embodiment of the case back cover assembly in accordance with the present invention.
Figure 5:
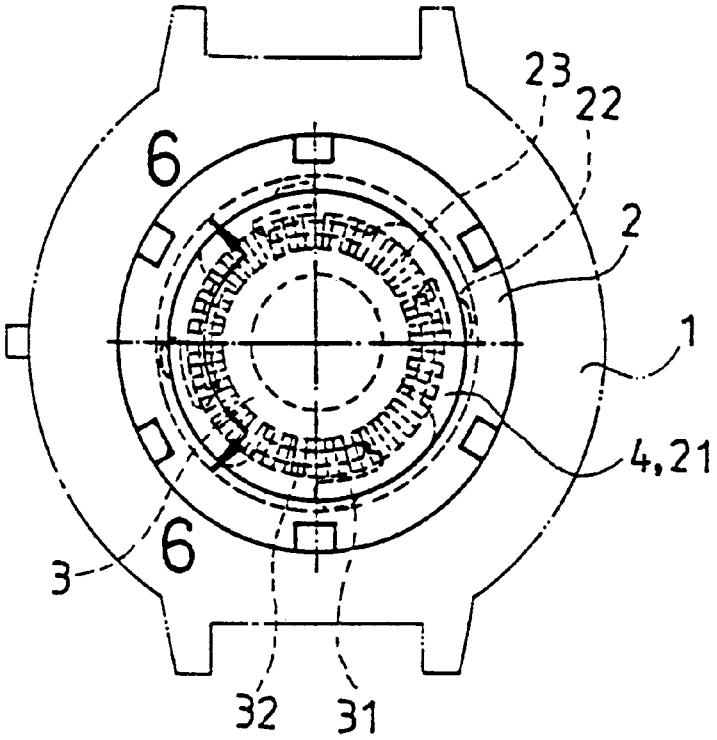
FIG. 5 is a rear side elevational view of the case back cover assembly in FIG. 4.
Figure 6:
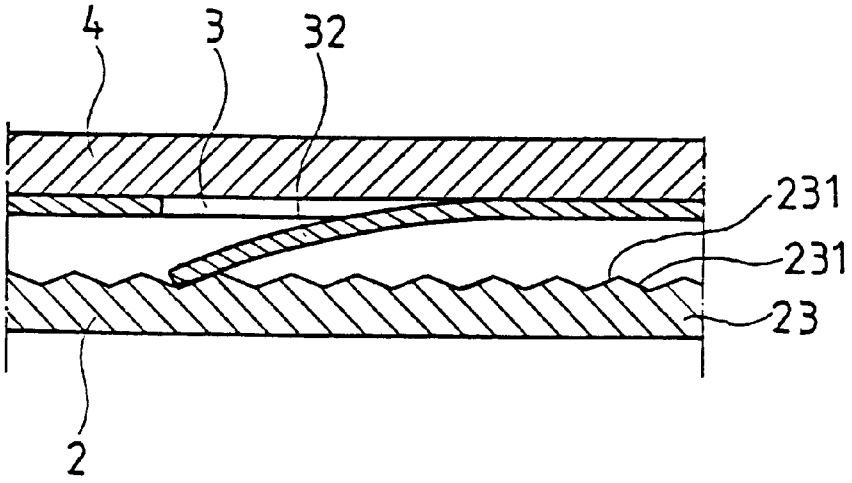
FIG. 6 is a sectional view taken along line 6—6 in FIG. 5.
Figure 7:
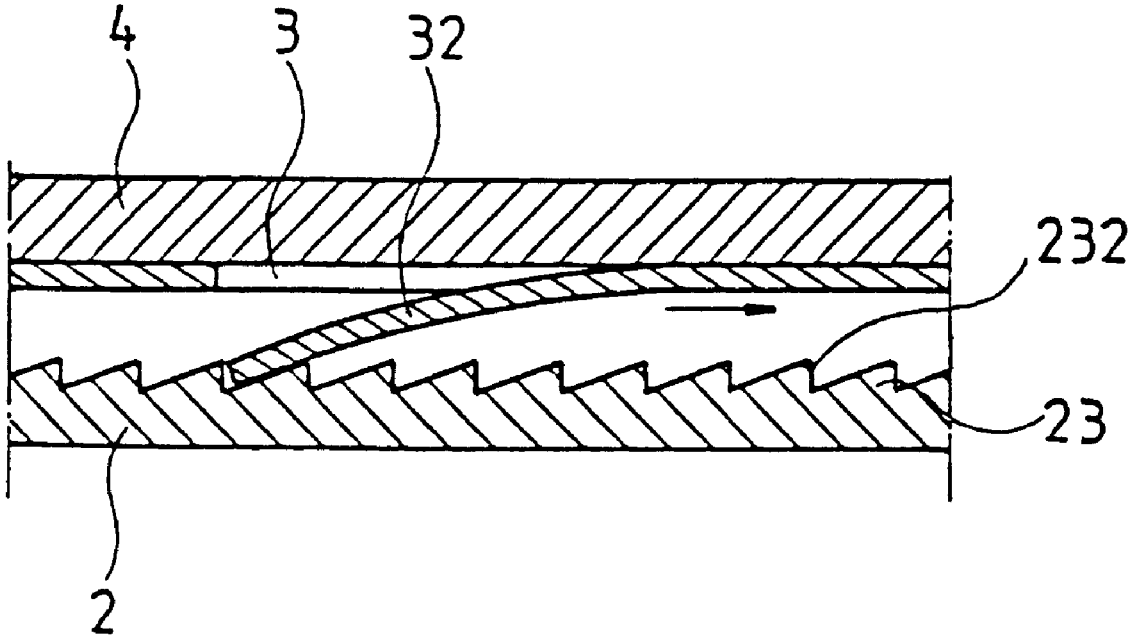
FIG. 7 is a sectional view similar to FIG. 6, illustrating a further modified embodiment of the case back cover assembly in accordance with the present invention.

FIG. 4 illustrates a modified embodiment of the invention in which the bottom surface defining the recess 21 may have an annular rack 23 formed thereon. The annular rack 23 may include continuous teeth 231 (FIG. 6). As shown in FIGS. 5 and 6, the elastic extensions 32 of the elastic member 3 may slide along the annular rack 23 and thus "click" during the movement thereof. The structure in FIG. 6 allows the user to rotate the cover plate 4 in either direction. FIG. 7 illustrates a further modified embodiment in which the annular rack 23 includes ratchet teeth 232 to allow rotation of the cover plate 4 in a single direction, and the cover plate 4 also may "click" during the movement thereof.

Although the invention has been explained in relation to its preferred embodiment, it is to be understood that many other possible modifications and variations can be made without departing from the spirit and scope of the invention as hereinafter claimed.

What is claimed is:

1. A watch case back cover assembly, comprising:

a case back cover adapted to be removably mounted to a case frame, the case back cover including a recess defining an outer side thereof, the recess being defined by a bottom surface and an annular periphery, and the annular periphery having an annular groove defined therein, an elastic member including at least one elastic piece slidably received in the annular groove and at least one elastic extension bearing against the bottom surface, and a cover plate secured to the elastic member to rotate therewith and having characters formed on an outer face thereof, whereby the cover plate is prevented from rotational movement relative to and disengagement from the case back cover as said at least one elastic extension bears against the bottom surface, and whereby the cover plate and the elastic member are rotatable relative to the case back cover when the cover plate is pressed.

2. The case back cover assembly according to claim 1, wherein the bottom surface defining the recess includes an annular rack formed thereon for engaging with said at least one elastic extension.

3. The case back cover assembly according to claim 2, wherein the annular rack includes continuous teeth to allow movement of said at least one elastic extension in either direction.

4. The case back cover assembly according to claim 2, wherein the annular rack includes ratchet teeth to allow movement of said at least one elastic extension in a single direction.

* * * * *